US007500526B2

(12) United States Patent
Telfer

(10) Patent No.: US 7,500,526 B2
(45) Date of Patent: Mar. 10, 2009

(54) DOWNHOLE TOOL

(75) Inventor: George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 0 days.

(21) Appl. No.: 11/597,093

(22) PCT Filed: May 26, 2005

(86) PCT No.: PCT/GB2005/002068

§ 371 (c)(1),
(2), (4) Date: Nov. 21, 2006

(87) PCT Pub. No.: WO2005/116393

PCT Pub. Date: Dec. 8, 2005

(65) Prior Publication Data

US 2007/0240883 A1 Oct. 18, 2007

(30) Foreign Application Priority Data

May 26, 2004 (GB) ..... 0411749.5

(51) Int. Cl.
*E21B 33/12* (2006.01)

(52) U.S. Cl. ..... 166/387; 166/373; 166/386; 166/150

(58) Field of Classification Search ..... 166/373, 166/386, 387, 260, 152, 188, 202, 318
See application file for complete search history.

(56) References Cited

U.S. PATENT DOCUMENTS 3,169,580 A * 2/1965 Bateman ..... 166/147
3,554,281 A * 1/1971 Ecuer ..... 166/155
4,099,563 A * 7/1978 Hutchison et al. ..... 166/191
4,921,046 A * 5/1990 Caskey ..... 166/170
4,949,788 A * 8/1990 Szarka et al. ..... 166/285
5,020,600 A * 6/1991 Coronado ..... 166/387
5,174,379 A * 12/1992 Whiteley et al. ..... 166/278
5,375,662 A * 12/1994 Echols et al. ..... 166/386
5,404,945 A * 4/1995 Head et al. ..... 166/155
6,439,312 B1 * 8/2002 Hess et al. ..... 166/313
6,609,569 B2 * 8/2003 Howlett et al. ..... 166/264
7,032,666 B2 * 4/2006 Corbett ..... 166/278
2001/0045288 A1 * 11/2001 Allamon et al. ..... 166/373

(Continued)

OTHER PUBLICATIONS

International Search Report for PCT/GB2005/002068 mailed Aug. 19, 2005 (2 pages).

*Primary Examiner*—David J Bagnell
*Assistant Examiner*—Cathleen R Hutchins
(74) *Attorney, Agent, or Firm*—Osha • Liang LLP

(57) ABSTRACT

A downhole tool (10) for use in isolating a formation in a well bore from fluid pressure introduced from the surface. Mounted in a work string, the tool provides an axial throughbore (18) and radial outlets (40, 42) above and below a permanent sealing element (26), such as a diverter cup. Valve members (44, 50) which may be nested sleeves located within the axial bore are manipulated by activation through the work string, to move sequentially such that (a) a first circulation path is created around the seal, via the radial outlets and independent of the axial throughbore; (b) the axial throughbore is obstructed and a second circulation path is estate fished between the axial throughbore and the upper radial outlet; and (c) flow is re-established through the axial bore while maintaining the second flow path.

17 Claims, 1 Drawing Sheet

U.S. PATENT DOCUMENTS

2002/0074128 A1* 6/2002 Allamon et al. ..... 166/373
2003/0192694 A1* 10/2003 Zachman et al. ..... 166/278
2004/0069496 A1 4/2004 Hosie et al.
2004/0084190 A1* 5/2004 Hill et al. ..... 166/386
2004/0094304 A1* 5/2004 Turner et al. ..... 166/313
2007/0272411 A1* 11/2007 Lopez De Cardenas et al. ..... 166/305.1
2007/0272413 A1* 11/2007 Rytlewski et al. ..... 166/318

* cited by examiner

DOWNHOLE TOOL

DOWNHOLE TOOL

The present invention relates to downhole apparatus used in the drilling and production of oil and gas wells and in particular, to a tool which controls circulation of fluid in a well bore so as to prevent downhole fluid pressure from adversely affecting a formation.

It is considered desirable in the art of drilling for oil or gas to be able to circulate fluid in the well bore. Typically fluid is circulated down a work string and on reaching an end thereof, it is directed back up the annulus between the work string and the wall of the well bore to the surface. However, due to the dynamics of pumping fluid down the work string and lifting it to the surface, excess fluid pressure is introduced into the well bore which, if exposed to the producing formation, can adversely effect the production of the well.

Permanent isolation of a formation can be achieved by cementing a liner or other tubular in the well bore at the formation. This provides a permanent barrier between the formation and the annulus. However, such an arrangement limits future developments around the formation. Consequently, packers have been developed to temporarily isolate formations. These rely on expandable materials which fill the annulus between the work string and the well bore wall above the formation. These have the disadvantages of fixing the location of the string in the well bore when the packer is expanded and require a means to expand the packer when it reaches the desired location.

It is an object of the present invention to provide a downhole tool which allows selective isolation of a formation from fluid pressure introduced into a well bore without requiring means to energize a packer and allows the tool to be moved within the well bore at all times.

It is a further object of the present invention to provide a downhole tool which allows isolation of a formation from fluid pressure introduced into a well bore while circulating fluid through the tool during movement of the tool.

According to a first aspect of the present invention there is provided downhole tool for use in isolating a formation from fluid pressure introduced into a well bore, the tool comprising a body member connectable in a work string with an axial bore providing passage for fluid between an axial inlet and an axial outlet through the work string, a permanent sealing element located around the body member for contact with a wall of the well bore, one or more first radial outlets through the body on a first side of the sealing element and one or more second radial outlets located through the body on an opposite side of the sealing element, a plurality of valve members actuable sequentially to: provide a first circulation path around the sealing element via the radial outlets and independent of the axial bore; obstruct an axial flow path between the axial inlet and axial outlet, and provide a second circulation path from the axial bore through the first radial outlets; and re-establish the axial flow path while maintaining the second circulation path.

Selective circulation around the permanent seal advantageously allows the tool and the work string to be both rotated and reciprocated without loss of the seal against the well bore wall. Sequentially blocking the axial bore and radial outlets isolates the formation from fluid pressure in the work string and in the annulus above the sealing element to prevent pressure being transmitted to the formation.

Preferably the permanent sealing element is a diverter cup. The cup may comprise an endless band of rubber having a surface to contact the well bore wall. Circumferential edges of the band may be located under facing lips arranged on the body member. These prevent the sealing member from movement on the body as the work string is moved within the well bore. The sealing element may be arranged to rotate relative to the body.

Each valve member may be locatable within the axial bore of the body member and preferably includes an axial passage in line with the axial bore of the body member. The valve members may be considered as inner sleeves and they may be nested sleeves within the axial bore.

Each valve member may be held in a respective first and second position by a pin or other mechanical means, the mechanical means becoming inoperable or fractured at a predetermined load or force. For example, one or more valve members may be held in its respective first and second position by one or more shear pins. Alternatively, hydraulic means may be employed to hold the or each valve member in the respective first position.

Advantageously the tool includes a damper or brake. The damper/brake acts to prevent more than one set of shear pins being sheared at a time so that the tool can operate sequentially.

Each valve member may be adapted to co-operate with a respective actuating device for actuating movement of the valve member between respective positions. One or more valve members may include at least one ball seat and the actuating device may be, for example, a drop ball suitable for landing on the ball seat, so as to temporarily block the axial passage through the apparatus and thereby enable an increase in fluid pressure capable of shearing the pin or other means for maintaining the valve member in an initial position.

Preferably each valve member includes at least one radial port. The at least one radial port may align with the first or second radial outlets.

Preferably also the tool may comprise one or more bypass channels which provide a fluid flow passage through the tool independent of the axial bore. These channels allow fluid flow to bypass the sealing element.

Preferably the or each radial outlet may be associated with filtration means for preventing the ingression of particles or debris into the body member of the apparatus.

According to a second aspect of the present invention there is provided a method of isolating a formation from fluid pressure introduced into a well bore, comprising the steps:

(a) connecting a tool into a work string, the tool including a permanent sealing element located thereon and outlets therethrough for directing fluid around the element;
(b) running the tool into the well bore while allowing fluid to bypass the sealing element by passing through a bypass channel around the sealing element in the tool;
(c) sealing the sealing element against a well bore wall;
(d) dropping a first ball through the work string to operate a valve within the tool to obstruct an axial flow path and circulate fluid from the axial bore radially out of the tool above the sealing element;
(e) moving the work string while maintaining the seal; and
(f) dropping a second ball through the work string to operate a further valve within the tool to re-establish the axial flow path while maintaining the circulation of fluid radially out of the tool above the sealing element.

In order to provide a better understanding of the invention, an embodiment will now be described by way of example only, and with reference to the accompanying Figures, in which.

Figure 1:
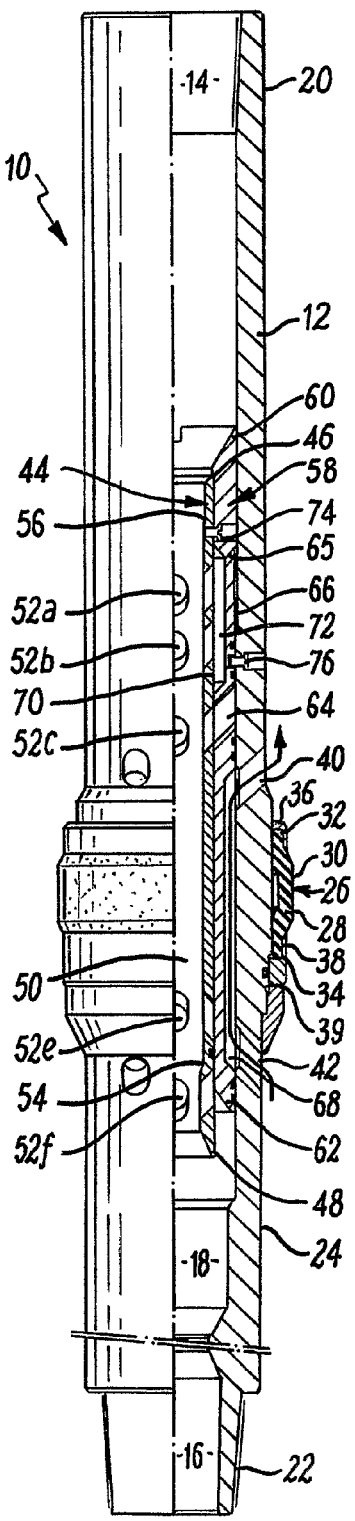
FIG. 1 is a part cross-sectional view through a downhole tool in a first operating position in accordance with the invention.

Referring initially to FIG. 1 of the drawings there is illustrated a downhole tool, generally indicated by reference numeral 10, according to an embodiment of the present invention. The tool 10 is comprised of an elongated body member 12 having an axial inlet 14 and an axial outlet 16. The outlet 16 is axially aligned with the inlet 14 to provide an axial bore 18 through the tool 10.

The body member 12 is provided with attachment means 20, 22 at each end thereof in the form of a box section and pin section respectively for connection of the tool 10 in a work string or drill string (not shown).

On an outer surface 24 of the body 12 is located a sealing element 26. The sealing element 26 comprises a rubber cup arranged circumferentially around the body 12. A mid portion 28 of the element 26 is raised to provide a sealing surface 30. The sealing surface 30 contacts the wall of the well bore to block fluid pressure passing the tool 10 within the annulus between the tool 10 and a wall of the well bore. Ends 32, 34 of the element 26 are held under oppositely facing overhanging lips 36, 38 on the outer surface 24. Located below the lower lip 38 is a bearing ring 39. Thus the sealing element 26 can rotate with respect to the body 12. In use, the sealing element 26 can remain static while the body 12 is rotated via the string.

A first radial outlet 40 is provided in the body member 12 in the form of a plurality of radially disposed apertures. Nozzles may be located in the apertures of the first radial outlets 40 to improve the cleaning efficiency of fluid expelled from the outlets 40 against the wall of a well bore in which the tool 10 is used.

A second radial outlet 42 is also provided in the body member 12 in the form of a plurality of radially disposed apertures. As is illustrated, the radial outlets 40, 42 are directed oppositely at an angle to the axial bore 18. This provides efficient direction of fluid into and out of the outlets 40, 42. The radial outlets 40, 42 are located at either side of the sealing element 26.

In the axial bore 18 is a first valve member, generally depicted at 44. The valve member 44 also has an inlet 46 and an outlet 48, there being an axial passage 50 between the inlet 46 and outlet 48. The valve member 44 includes five radial ports 52*a-f*, in the form of a plurality of radially disposed apertures, arranged along its length. Towards the outlet 48, within the passage 50, there is located a first ball seat 54. The first ball seat 54 will arrest the passage of a ball having a first diameter through the valve member 44. Towards the inlet 46 within the passage 50, there is located a second ball seat 56. The second ball seat 56 will arrest the passage of a ball having a second diameter through the valve member 44, the first diameter being smaller than the second diameter.

Also in the axial bore 18 is a second valve member, generally depicted at 58. The valve member 58 also has an inlet 60 and an outlet 62, there being an axial passage between the inlet 60 and outlet 62 in which is located the first valve member 44. Each valve member 44, 58 can be considered as a sleeve and the sleeves are nested within the bore 18 of the tool 10.

The second valve member 58 includes a radial port 64, in the form of a plurality of radially disposed apertures circumferentially arranged on the member 58. Further on an outer surface 66 of member 58 is located a plurality of longitudinally arranged channels 68. On the inner surface 70 of the member 58 is located a further plurality of longitudinally arranged channels 72. To ensure the channels 68, 72 are aligned with the ports 52, 64 and the radial outlets 40, 42 locating pegs and slots may be arranged between the body 12 and the valve members 44, 58. In an alternative embodiment the channels 68, 72 are replaced with a pair of circumferentially arranged recesses around the surfaces 66,70 respectively.

Initially, as illustrated in FIG. 1, the valve members 44, 58 are mechanically held together via a first shear pin 74. The second valve member 58 is also held to the body member 12 by a second shear pin 76. The second shear pin 76 is rated to shear at a lower pressure than the first shear pin 74.

Seals are provided between the body 12 and valve members 44, 58 to prevent the ingress of fluid from the bypass channels to the bore 18.

Further filters can be arranged across the radial outlets 40, 42 to prevent debris entering the channel 68 which could block the passageway.

In use, the valve members 44, 58 are located within the bore 18 and held by the shear pins 74, 76. This is as illustrated in FIG. 1 and may be considered as the first position. The tool 10 is then mounted on a work string and run into a well bore to a position above a formation or other well component which is required to be isolated.

When in the first position, fluid may circulate through the work string via the tool 10 by entering the inlet 14, passing through the bore 18 and exiting the outlet 16. Fluid circulating up the annulus between the tool 10 and the wall of the well bore will be directed into the tool 10 at radial outlet 42, pass along the channel 68 behind the sealing element 26 and re-enter the annulus above the sealing element 26 by passing out of radial outlet 40. In this way the sealing element 26 can be in contact, via the sealing surface 30, with the wall of the well bore. Due to the flexibility and self-adjusting nature of the element 26, the work string together with the tool 10 can be rotated and reciprocated in the well bore while a seal is maintained between the two. The channel 68 ensures an equalization of fluid pressure on either side of the sealing element 26 which prevents surging and swabbing problems.

Following fluid fill on run-in, the fluid can now be displaced from the tool 10. This is achieved by dropping a ball 80 through the work string into the bore 18 and through the passage 50. The ball 80 comes to rest on the seat 54 on the first valve member 44. When the ball 80 is located on the seat 54, fluid flow is temporarily prevented through the tool 10 for so long as the valve members 44, 58 remain in the first position. This allows fluid pressure to be built up above the ball 80, from the fluid being pumped down the work string, until the force on the ball 80 and valve members 44, 58 is sufficient to shear the second pin 76. Once this occurs, the valve members 44, 58 move down through the bore 18 in the body member 12 until the second valve member 58 is stopped by a shoulder 82 in the bore 18. The tool 10 is then at what is generally referred to herein as the second position.

A further feature of the tool 10 is a damper or brake. When the tool 10 is in the first position, fluid within the bore 50 can travel into channel 72 and through to channel 66 via a port 65 in the valve member 58. When the tool 10 is moved to the second position, the valve members 44, 58 move together over the body 12. During the movement, the channel 66 is reduced in size as opposing faces of the channel 66 on the member 58 and body 12 are brought together. The fluid in the channel 66 is thus squeezed out through the port 65 during the movement.

Due to the dimensions of the port 65, the fluid can only slowly escape into the bore 50 and this controls the movement of the valve members 44, 58 with respect to the body 12. Thus any jarring action on shearing pins 76 is prevented and thus there is no risk of causing shearing of the pins 74 at the same time. The fluids slow escape through the port 65 improves the dampening or braking effect between movement of the body 12 and the members 44, 58.

Figure 2:
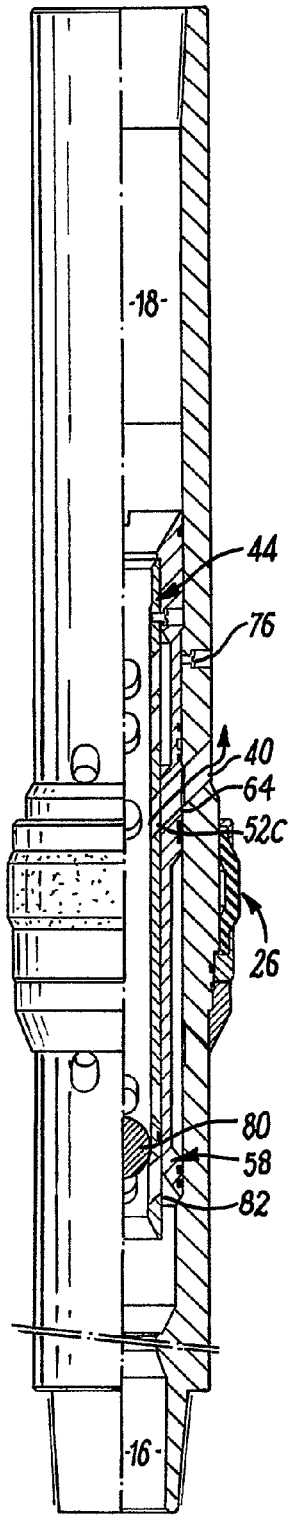
FIG. 2 illustrates the tool of FIG. 1, now in a second operating position.

Reference is now made to FIG. 2 of the drawings which illustrates the tool 10 in the second position. Like parts to those of FIG. 1 have been given the same reference numeral to aid clarity.

When the tool 10 is in the second position, the outlet 16 is closed by virtue of the ball 80 blocking the bore 18. This prevents fluid from passing down through the work string passed the tool 10. Movement of the valve members 44, 58 causes the radial outlet 42 in the body 12 below the sealing element 26 to be obstructed by the valve member 58. The bypass channel 68 is closed. There is now no fluid flow in the work string or in the annulus below the sealing element 26 and the well is effectively shut-off. Any formation located below the sealing element 26 is isolated from the fluid pressure in the work string and in the annulus above the sealing element 26.

Fluid is displaced from the bore 18 of work string to the annulus above the sealing element 26, providing a circulation path in the well bore. This is achieved as, in the second position, the ports 52*c* and 64 on the valve members 44, 58 align with the first radial outlet 40 on the body 12.

When the tool 10 is required to be removed from the well bore, a second drop ball 84 is released into the work string. The ball 84 comes to rest on the seat 56 on the first valve member 44. When the ball 84 is located on the seat 56, fluid flow is temporarily prevented through the tool 10 for so long as the valve members 44, 58 remain in the second position. This allows fluid pressure to be built up above the ball 84, from the fluid being pumped down the work string, until the force on the ball 84 and valve members 44, 58 is sufficient to shear the first pin 74 between the members 44, 58. Once this occurs, the first valve member 44 moves down through the second valve member 58 until it is stopped by a shoulder 86 in the bore 18. The tool 10 is then at what is generally referred to herein as the third position.

Figure 3:
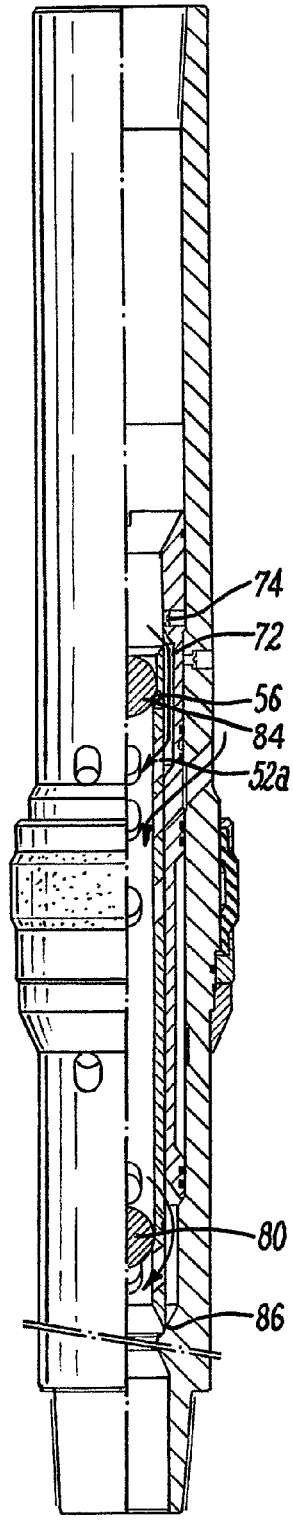
FIG. 3 illustrates the tool of FIG. 1, now in a third operating position.

Reference is now made to FIG. 3 of the drawings which illustrates the tool 10 in the third position. Like parts to those of FIGS. 1 and 2 have been given the same reference numeral to aid clarity.

Movement of the valve members 44, 58 relative to each other causes further fluid flow paths to be exposed. The second ball seat 56 is arranged between an upper end of the first valve member 44 and the port 52*a* in the member 44. In the third position, these parts lie across the channel 72 in the second valve member 58. Thus fluid can travel from the bore 18 through the channel 72 and return to the bore 18 via port 52*a*, bypassing the ball 84. Port 52*b* now aligns with port 64 and the radial outlet 40 such that fluid in the annulus above the sealing element 26 is directed into the bore 18. Further ports 52*e*, 52*f*, which are arranged on either side of the lower ball seat 54, are now located below the second valve member 58 and thus a fluid passageway is available between the first valve member 44 and the body 12 at this point. Fluid within the bore 18 can exit the passageway 50 through port 52*e*; travel through the bore 18 in contact with the body 12 and return to the passageway 50 through port 52*f* to exit through the outlet 16. This flow path bypasses the first drop ball 80. In this way, the work string together with the tool can be removed from the well bore.

The principal advantage of the present invention is that it provides a downhole tool which allows selective isolation of a formation from fluid pressure introduced into a well bore without requiring means to energize a packer. A further advantage is that the tool can be moved within the well bore at all times while still providing a pressure resistant seal between the work string and the well bore wall. A yet further advantage of the present invention is that it provides a well shut-off device where fluid flow can be redirected from the tool and re-established through the tool.

It will be appreciated by those skilled in the art that various modifications and improvements may be incorporated without departing from the scope of the invention herein intended. For example typically four apertures are provided at each of the ports and outlets, this can be increased or decreased, while still maintaining a sufficient flow rate through the ports and outlets. Other mechanical means such as springs may be used in place of the shear pins. Such springs would allow automatic resetting of the tool when the drop balls are removed.

The invention claimed is:

1. A downhole tool for use in isolating a formation from fluid pressure introduced into a well bore, the tool comprising a body member connectable in a work string with an axial bore providing passage for fluid between an axial inlet and an axial outlet through the work string, a permanent sealing element located around the body member for contact with a wall of the well bore, one or more first radial outlets through the body on a first side of the sealing element and one or more second radial outlets located through the body on an opposite side of the sealing element, a plurality of valve members actuable sequentially to a) provide a first circulation path around the sealing element via the radial outlets and independent of the axial bore;

(b) obstruct an axial flow path between the axial inlet and axial outlet, and provide a second circulation path from the axial bore through the first radial outlet; and (c) re-establish the axial flow path while maintaining the second circulation path.

2. The downhole tool as claimed in claim 1 wherein the permanent sealing element is a diverter cup.

3. The downhole tool as claimed in claim 2 wherein circumferential edges of the cup are located under facing lips arranged on the body member.

4. The downhole tool as claimed in claim 1 wherein each valve member is located within the axial bore of the body member.

5. The downhole tool as claimed in claim 1 wherein the valve members are sleeves, nested within the axial bore.

6. The downhole tool as claimed in claim 1 wherein each valve member is held in a respective first position by mechanical means, the mechanical means becoming inoperable or fractured at a predetermined load or force.

7. The downhole tool as claimed claim 1 wherein each valve member is held in a respective first position by hydraulic means.

8. The downhole tool as claimed in claim 1 wherein the tool includes a damper or brake.

9. The downhole tool as claimed in claim 6 wherein each valve member is adapted to co-operate with a respective actuating device for actuating movement of the valve member between respective first and second positions.

10. The downhole tool as claimed in claim 9 wherein one or more valve members include at least one ball seat and the actuating device is a drop ball suitable for landing on the ball seat, so as to temporarily block the axial passage through the apparatus and thereby enable an increase in fluid pressure capable of operating the means for maintaining a valve member in the first position.

11. The downhole tool as claimed in claim 1 wherein each valve member includes at least one radial port, the port being aligned with a radial outlet.

12. The downhole tool as claimed in claim 1 wherein the tool comprises one or more bypass channels which provide a fluid flow passage through the tool independent of the axial bore to bypass the sealing element.

13. A downhole tool as claimed in claim 1 wherein the or each radial outlet is associated with filtration means for preventing the ingression of particles or debris into the body member of the apparatus.

14. The method of isolating a formation from fluid pressure introduced into a well bore, comprising the steps:

(a) connecting a tool into a work string, the tool including a permanent sealing element located thereon, and outlets therethrough for directing fluid around the element;

(b) running the tool into the well bore while allowing fluid to bypass the sealing element by passing through a bypass channel around the sealing element in the tool;

(c) sealing the sealing element against a well bore wall;

(d) dropping a first ball through the work string to operate a valve within the tool to obstruct an axial flow path and circulate fluid from the axial bore radially out of the tool above the sealing element;

(e) moving the work string while maintaining the seal; and (f) dropping a second ball through the work string to operate a further valve within the tool to re-establish the axial flow path while maintaining the circulation of fluid radially out of the tool above the sealing element.

15. The method as claimed in claim 14 wherein step (e) includes rotating the work string.

16. A method as claimed in claim 14 wherein step (e) includes reciprocation of the work string.

17. The downhole tool as claimed in claim 1, wherein the sealing element is arranged to rotate relative to the body.

* * * * *